US011324361B2

(12) United States Patent
Ziebart et al.

(10) Patent No.: US 11,324,361 B2
(45) Date of Patent: May 10, 2022

(54) DISPENSER FOR MULTIPLE ROLLS OF WEB MATERIAL

(71) Applicant: San Jamar, Inc., Elkhorn, WI (US)

(72) Inventors: Bernie Ziebart, Pewaukee, WI (US); Jodie Schoon, East Troy, WI (US); Nagaraj Thyadi, Andhrapradesh (IN); Gurucharan Vasa, Hyderabad (IN); Kirk L. Deheck, Port Washsington, WI (US)

(73) Assignee: San Jamar, Inc., Elkhorn, WI (US)

( * ) Notice: Subject to any disclaimer, the term of this patent is extended or adjusted under 35 U.S.C. 154(b) by 87 days.

(21) Appl. No.: 16/837,624

(22) Filed: Apr. 1, 2020

(65) Prior Publication Data

US 2021/0307569 A1 Oct. 7, 2021

(51) Int. Cl.

| | |
|---|---|
| ***A47K 10/36*** | (2006.01) |
| ***A47K 10/38*** | (2006.01) |
| ***A47K 10/32*** | (2006.01) |

(52) U.S. Cl.

CPC ..... *A47K 10/3687* (2013.01); *A47K 10/38* (2013.01); *A47K 2010/3233* (2013.01); *A47K 2010/3253* (2013.01)

(58) Field of Classification Search

CPC ..... A47K 10/3687; A47K 10/38; A47K 2010/3233; A47K 2010/3253

See application file for complete search history.

(56) References Cited

U.S. PATENT DOCUMENTS

| | | | | |
|---|---|---|---|---|
| 3,387,902 | A | 6/1968 | Perrin et al. | |
| 3,677,485 | A * | 7/1972 | Berg | A47K 10/3836 242/560.3 |
| 4,143,827 | A * | 3/1979 | Tucker | A47K 10/3836 242/560.3 |
| 4,422,584 | A | 12/1983 | Dashnier et al. | |
| 4,807,823 | A | 2/1989 | Wyant | |
| D312,179 | S | 11/1990 | De Luca et al. | |
| 5,370,336 | A | 12/1994 | Whittington | |
| 5,690,299 | A | 11/1997 | Perrin et al. | |

(Continued)

FOREIGN PATENT DOCUMENTS

| | | |
|---|---|---|
| EP | 1321084 A1 | 6/2003 |
| WO | 2008/042961 A2 | 4/2008 |

OTHER PUBLICATIONS

The European Extended Search Report, dated Sep. 1, 2021.

*Primary Examiner* — William A. Rivera

(74) *Attorney, Agent, or Firm* — Boyle Fredrickson S.C.

(57) ABSTRACT

A multiple roll tissue material dispenser assembly and method for forming a dispenser configured to dispense respective vertically stacked rolls of tissue material. The dispenser assembly includes a carriage that moveably cooperates with a support frame to allow dispensing access to a second vertically stacked roll of tissue material without outside interference. The carriage supports an actuator assembly that cooperates with a lower roll of tissue material and a channel defined by the support frame to allow selective access to an upper roll of tissue material. Depletion of the lower roll of tissue material effectuates rotation of the actuator to automatically effectuate the gravitationally downward slideable translation of the carriage relative to the support frame to allow access to an upper roll of tissue material supported by the carriage.

25 Claims, 12 Drawing Sheets

(56) References Cited

U.S. PATENT DOCUMENTS

| | | | | |
|---|---|---|---|---|
| 5,813,624 | A | 9/1998 | Grasso et al. | |
| 5,873,542 | A | 2/1999 | Perrin et al. | |
| 6,056,233 | A | 5/2000 | Von Schenk | |
| 6,138,939 | A | 10/2000 | Phelps et al. | |
| 6,202,956 | B1 | 3/2001 | Grasso et al. | |
| 6,382,553 | B1 | 5/2002 | Lewis et al. | |
| 6,386,479 | B1 | 5/2002 | Lewis et al. | |
| 6,752,349 | B2 | 6/2004 | Moody et al. | |
| 7,083,138 | B2 | 8/2006 | Elliott et al. | |
| 7,219,852 | B2 | 5/2007 | Tramontina et al. | |
| D547,581 | S | 7/2007 | Cittadino et al. | |
| D550,999 | S | 9/2007 | Formon et al. | |
| D551,474 | S | 9/2007 | Cittadino et al. | |
| D572,058 | S | 7/2008 | Cittadino et al. | |
| 7,568,652 | B2 | 8/2009 | Cittadino et al. | |
| 7,967,235 | B2 | 6/2011 | Forman et al. | |
| 8,162,252 | B2 * | 4/2012 | Cittadino | A47K 10/3687 242/560 |
| D667,661 | S | 9/2012 | Norton | |
| 9,138,110 | B2 * | 9/2015 | Knight | A47K 10/38 |
| D761,585 | S | 7/2016 | Roche et al. | |
| D766,612 | S | 9/2016 | Roche et al. | |
| D781,067 | S | 3/2017 | Cross et al. | |
| D807,076 | S | 1/2018 | Kapiloff et al. | |
| 10,213,070 | B2 | 2/2019 | Osborne, Jr. | |
| 2003/0146337 | A1 * | 8/2003 | Moody | A47K 10/38 242/594 |
| 2009/0266930 | A1 * | 10/2009 | Friesen | A47K 10/3687 242/560 |
| 2016/0037979 | A1 | 2/2016 | Mattheeussen et al. | |
| 2019/0104895 | A1 * | 4/2019 | Johnson | A47K 10/3687 |
| 2020/0305656 | A1 * | 10/2020 | Landa | A47K 10/3687 |

* cited by examiner

DISPENSER FOR MULTIPLE ROLLS OF WEB MATERIAL

BACKGROUND

This invention relates generally to dispensers for dispensing rolled material. More particularly, the invention relates to a web or paper tissue material dispensing apparatus having a carriage that is moveable relative to a housing or support frame and is operable to provide sequential access to multiple rolls of web material supported in a vertical orientation.

Dispensers for rolls of flexible sheet material, such as bath tissue, toilet tissue and paper towels, have been employed for many years. Such dispensers are widely used in public lavatories to dispense sheet material for users. Typically, in the context of toilet tissue, one or more rolls of web material are rotatably supported inside a dispenser cabinet. Often these dispenser cabinets are configured to generally enclose two or more rolls of material to reduce the frequency associated with restocking of the dispenser. Some multiple roll dispenser assemblies provide the multiple rolls in a fully open or exposed configuration lauded as allowing the user to readily assess the availability of a desired or necessary volume of tissue material. Such configurations leave the multiple rolls of tissue material susceptible to theft, vandalism, and present the multiple rolls of tissue material in a manner that fails to adequately protect the sanitary condition of the one or more rolls of exposed and/or available tissue material.

In an effort to improve the sanitary and secure presentation of multiple rolls of tissue materials, others provide tissue dispenser assemblies that more fully limit access to the discrete rolls of tissue material—and particularly the unused or stowed rolls of tissue material and are constructed to mitigate nefarious interaction with the dispenser and/or the one or more rolls of tissue associated therewith. Although such dispensers are operable to better improve the security and sanitary condition of the various rolls of tissue material, such dispensers commonly suffer from various other shortcomings.

Some such tissue dispenser systems or assemblies includes a feed or advancement mechanism that maintains a first roll of material in a dispense orientation associated with access to the roll of tissue material by a user while other rolls are stored in the dispenser. In some configurations, deletion of one roll is not necessary to effectuate advance of a subsequent roll to the dispense orientation. After periods of use, such an approach commonly renders the dispenser assembly as housing multiple partially depleted rolls of tissue material. Such instances frustrate service efforts and commonly result in the replacement and waste of multiple partially depleted rolls of tissue material. Recognizing such a shortcoming, other tissue dispenser assemblies include lock or stop features that prevent advancement of subsequent rolls of tissue material to the dispense location until a current roll is fully or near fully depleted. Unfortunately, many such advancement mechanism require user actuation or interaction with at least one of the housing or a feed mechanism to effectuate the translation of subsequent rolls to the dispense location.

Variations in the actuation mechanisms and methods of actuation tend to leave users confused as the interactions required to effectuate the desired advancement operation. Such confusion tends to result in improper or forced operation of the advancement or access structures and can lead to damage to the dispenser assembly and/or the advancement mechanisms. When severe, such interactions can result in damage to the dispenser assembly and/or inoperability of the advancement and/or accessibility mechanism and render the dispenser assembly unusable or inoperable for dispensing multiple rolls of tissue material in a sequential manner. Still further, and regardless of the intuitive nature associated with operation of the access or advancement mechanism, tissue dispenser assemblies that require user interaction with a portion of the housing; such as moveable door or cover; or advancement mechanisms; whether dial, lever, or button actuated; tend to detract from the sanitation associated with use and operation of such dispenser assemblies.

In an effort to mitigate one or more of the shortcomings disclosed above, other tissue dispensers are constructed to dispense multiple rolls of tissue material in a sequential manner and in manners that required limited user interaction with the dispenser assembly to effectuate the advancement operation. Unfortunately, such approaches suffer from yet further shortcomings associated with the continued use and service of such devices. Many such system are susceptible to inoperability of the advancement mechanism if loaded with rolls of tissue material that are not constructed in accordance with specific and generally limited tolerances associated with the construction of the discrete rolls and/or requisite tensile strengths associated with the tissue material wound thereupon. That is, slight deviations in the material qualities of the tissue material, the dimensions defined by the roll or the core thereof can result in an unacceptable quality of the rotation dispense events and/or jamming of the respective roll advancement mechanisms or structures.

Many approaches to providing touchless advancement of discrete rolls of tissue material to the dispense opening include moveable and/or removeable carriage assemblies that cooperate with an underlying housing and are moveable or removeable to effectuate the reloading operations effectuated by service personnel. When provided in movable configurations, the movable operation of the carriage relative to the housing is commonly less intuitive than the advancement or access mechanisms disclosed above and can frustrate service personnel during reloading operations and are commonly more time consuming to effectuate.

Although generally similarly non-intuitive as tissue dispenser assemblies that provide moveable carriages, multiple roll tissue dispensers having removeable carriages suffer from additional drawback. For instance, interruption of service personnel during service activities can result in loss or misplacement of the carriage. Still further, such assemblies commonly require an exact orientation, association, and/or sequence of association of the carriage relative to the remainder of the dispenser housing to achieve the desired interaction of the carriage with the dispenser assembly to effectuate the desired sequential, and preferably complete, dispensing of multiple rolls of tissue material from the dispenser assembly once reloaded and deployed. The re-association of a removeable carriage with the underlying dispenser assembly can further detract from ability of service personnel to efficiently and expeditiously reload such dispenser assemblies. Such shortcomings can be exacerbated even when common service personnel are responsible for the maintenance, service, and/or reloading of multiple tissue dispensers associated with facilities having multiple restrooms and multiple dispenser assemblies deployed in each restroom.

There is therefore a need for a multiple roll tissue dispenser assembly for reducing service frequency, which maintains yet to be accessible rolls of tissue material in a secure and sanitary manner, presents a roll of tissue material being consumed in a sanitary manner, can effectuate touchless and/or automatic presentation and/or access to subsequent rolls of tissue material, preferably does so in a manner that mitigates premature access to subsequent rolls of tissue prior to consumption of the currently in-use roll, and provides intuitive interaction during each of use, advancement, and reloading operations.

SUMMARY

The present application discloses a multiple roll tissue dispenser or dispenser assembly that resolves one or more of the shortcomings disclosed above. One aspect of the present application discloses a dispenser apparatus that is configured to sequentially dispense a first and a second roll of web and/or tissue material, from a carriage held in a frame. Upon emptying the first roll of tissue material, the dispenser assembly is constructed to automatically move the carriage relative to the frame to allow dispensing of the second roll of tissue material. The carriage preferably utilizes a retention member configured to cooperate with a channel defined by the support frame and actuation of the retention member is preferably effectuated by a load bar that is biased against the lower roll of tissue material. Upon depletion of the lower roll of tissue material, rotation of the load bar and respective retention member allows slideable translation of the carriage relative to frame to facilitate user access to the second roll of tissue material. Loading of multiple rolls of tissue material is effectuated by translation of the carriage to an intermediary position which accommodates fore and aft rotation of opposing vertically oriented ends of the carriage relative to the support frame.

In one aspect, when a bottom or lower roll of tissue material is empty, the carriage automatically drops down so an upper roll of tissue material is available to be dispensed. The assembly preferably includes a cover that can opened to facilitate reloading when the upper and lower rolls of tissue material are depleted. During reloading operations, the carriage is slightly elevated or raised relative to the support frame such that the lower end of the carriage can be brought forward such that a lower roll of tissue can be engaged with the carriage. Upon loading the lower roll of tissue material, the carriage can be rotated in an opposing direction to bring the top of the carriage forward to accommodate loading of the upper roll of tissue material. Once the multiple rolls of tissue material are loaded or operationally associated with the dual roll carriage, the carriage can be rotated toward an upright oriented and associated with the support frame in a manner that facilities automatic gravitational vertical translation of the carriage relative to the support frame during use. Finally, the cover is closed such that the dispenser assembly is available for subsequent use.

Another aspect of the invention may provide a tissue material dispensing apparatus that includes a carriage configured to support upper and lower rolls of tissue material. The carriage is configured to cooperate with a frame or carriage support frame and is moveable relative thereto between respective first and second positions. The first position of the carriage relative to the support frame is associated with presenting the lower roll of tissue material in an orientation wherein the lower roll can be unwound during dispensing and the upper roll is spaced from the lower roll and generally inaccessible to the user of the first roll. Preferably, the second position of the carriage relative to the support frame can only be attained when the first or lower roll of tissue material is depleted. When in the lower of second position, the upper roll of tissue material is rendered available or accessible upon the generally vertical movement of the carriage relative to the support frame.

Another aspect of the application discloses a dispensing apparatus having a support frame that includes a channel and a carriage that is constructed to support respective upper and lower rolls of tissue material and slideably cooperate with the support frame such that the carriage is moveable between respective first or upper and second or lower positions. The carriage is constructed to cooperate with the support frame such that the carriage moves from the upper position toward the lower position without outside interference when the lower roll of tissue material is depleted. The dispensing apparatus preferably includes a cover that is pivotably connected to the support frame and is operable when oriented in a closed position to obscure or hide away the upper roll of tissue material when the lower roll of tissue material is available and allow presentation of a portion of the upper roll of tissue material upon depletion of the lower roll of tissue material upon slideable translation of the carriage toward the lower position.

A further aspect of the application discloses a dispenser assembly that is configured to dispense multiple vertically stacked rolls of tissue material wherein the vertically stacked rolls of tissue material are spaced from one another. The dispenser assembly includes a carriage that is configured to support multiple rolls of tissue material and a support frame that is constructed to receive the carriage so that the carriage is selectively slideable relative to the support frame between a first orientation wherein a lower roll of tissue material is available to be dispensed and a second orientation wherein an upper roll of tissue material is available to be dispensed. A follower path is defined by the support frame and an actuator is supported by the carriage and oriented to engage a roll of tissue associated therewith. A follower is connected to the actuator and oriented to cooperate with the follower path so that the follower is rotatable relative to the follower path to selectively allow the carriage to move from the first orientation toward the second orientation relative to the support frame in response to rotation of the actuator indicative of depletion of the lower roll of tissue material.

Another aspect of the application discloses a dispensing apparatus that includes a support frame having at least one channel and a carriage configured to hold upper and lower tissue rolls. The carriage is constructed to slideably cooperate with at least one channel defined the support frame such that the carriage is automatically moveable relative to the support frame between an upper position and a lower position. An actuator is supported by the carriage and oriented to interact with the lower roll of tissue and cooperate with the at least one channel such that rotation of the actuator relative to the carriage allows translation of the carriage relative to the support frame from the upper position toward the lower position. A cover is preferably connected to the support frame and configured to obstruct access to an upper tissue roll when the carriage is the in the upper position and allow access to a portion of the upper tissue roll when the carriage is oriented in the lower position.

A further aspect of the application discloses a method for forming a multiple roll tissue dispenser assembly. The method includes providing a carriage for supporting multiple rolls of tissue material in a vertically stacked orientation such that the carriage defines an axis of rotation of each discrete roll of tissue material such that the respective rolls of tissue material remain offset from one another. The carriage is attached to a support frame so that the carriage is slideable between a first position and a second position relative to the support frame and wherein the first position being a raised position for dispensing a lower roll of tissue material and the second position is a lowered position for dispensing an upper roll of tissue material. An actuator is provided that engages the lower roll of tissue material and cooperates with a channel defined by the support frame so that rotation of the actuator in response to depletion of the lower roll of tissue material allows the carriage to move from the first position toward the second position upon depletion of the lower roll of tissue material.

Another aspect to the present application discloses a multiple roll tissue material dispenser assembly and method for forming a dispenser that is configured to dispense respective vertically stacked rolls of tissue material. The dispenser assembly includes a carriage that moveably cooperates with a support frame to allow dispensing access to a second vertically stacked roll of tissue material without outside interference. The carriage supports an actuator assembly that cooperates with a lower roll of tissue material and a channel defined by the support frame to allow selective access to an upper roll of tissue material. Depletion of the lower roll of tissue material effectuates rotation of the actuator to automatically effectuate the gravitationally downward slideable translation of the carriage relative to the support frame to allow access to an upper roll of tissue material supported by the carriage.

A further aspect of the present application that is useable or combinable with one or more of the above features and aspects discloses a multiple vertically stacked rolls of tissue material dispenser that includes multiple carriages that cooperate with a support frame in a side-by-side orientation relative to one another. Each carriage is preferably configured to cooperate with a respective dual roll cavity defined by a support frame such that each frame is independently moveable relative thereto. Each carriage preferably includes an actuator assembly having at least one follower that slideably cooperates with a respective channel defined by the support frame. Each actuator assembly preferably engages a respective one of the lower rolls of tissue material and is operable to facilitate rotation of the respective follower relative to the respective channel to allow vertical slideable translation of the corresponding carriage relative to the support frame upon depletion of the discrete lower roll of tissue material and thereby providing dispensable access to the respective upper roll of tissue material. Such a dispenser assembly can provide dual column, dual roll, tissue material dispensing wherein access of upper oriented rolls is prevented until depletion of respective lower rolls and access to the respective upper rolls is effectuated automatically or without outside interference with the dispenser assembly. It is further appreciated that such a dispenser assembly may be provided in other numbers of multiple columns of multiple rolls of tissue material.

These and various other features, aspects and advantages of the invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
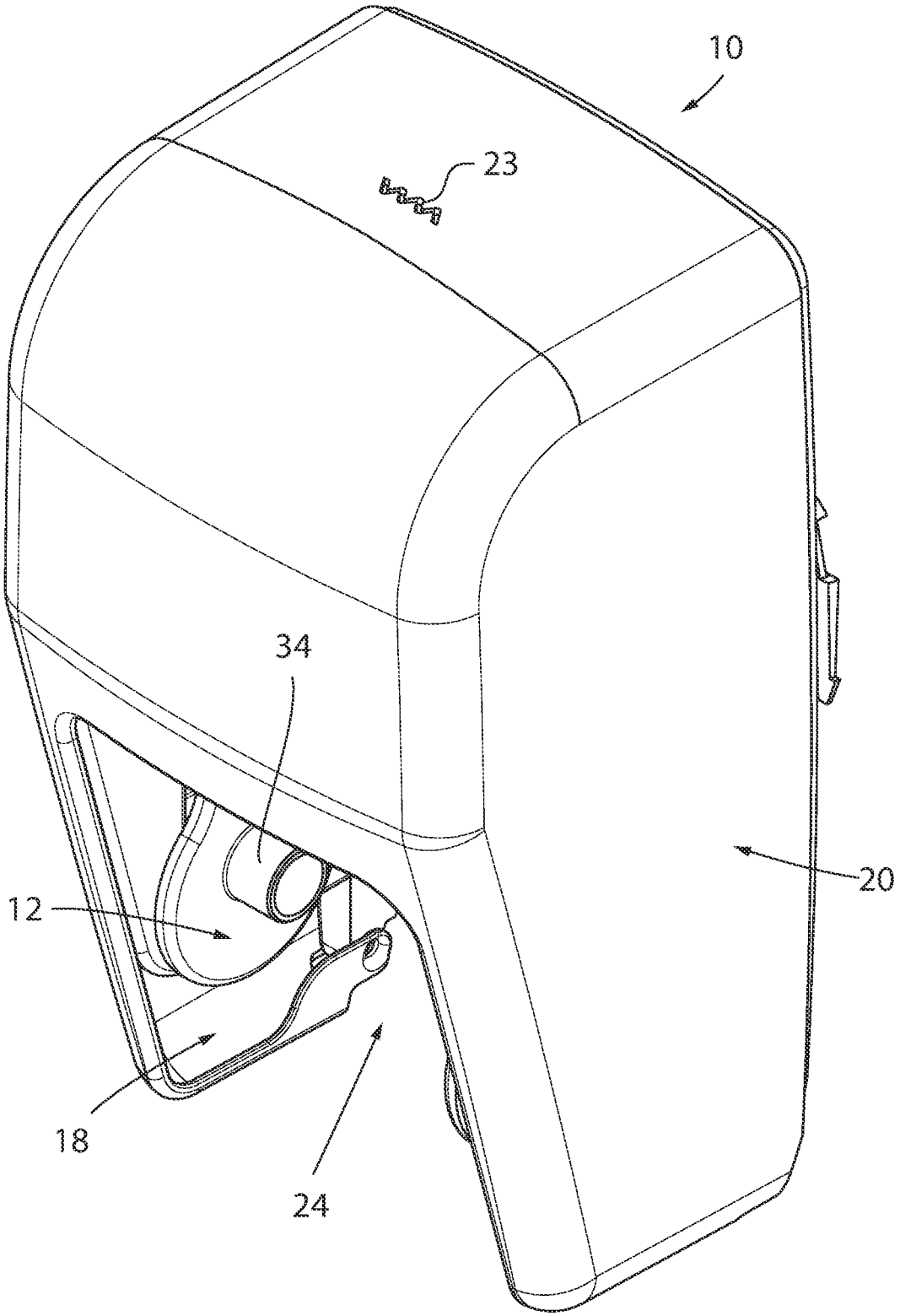
FIG. 1 is an isometric front view of a dual roll tissue material dispensing apparatus in accordance with one embodiment of the present invention.
Figure 2:
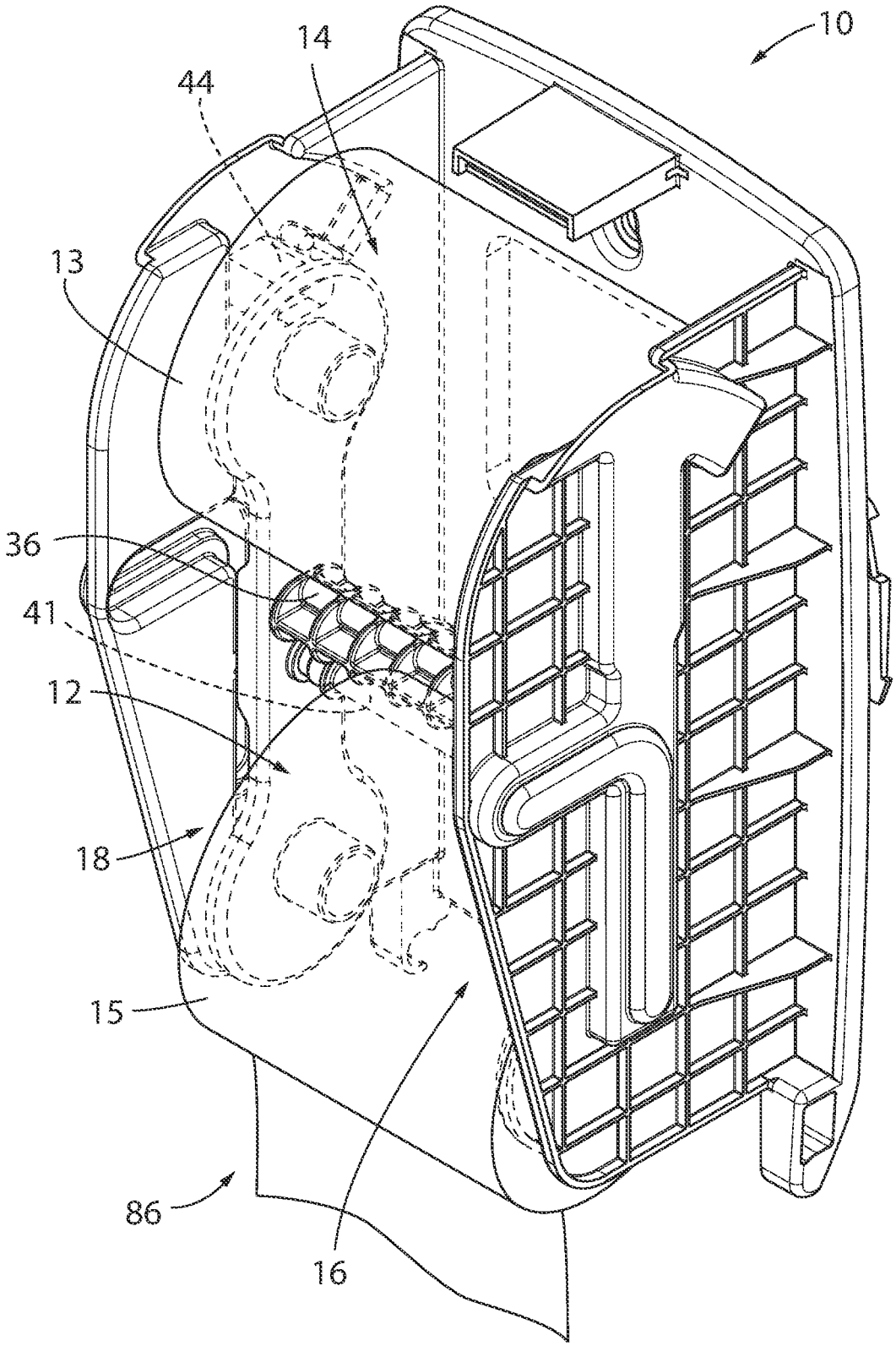
FIG. 2 is an isometric front view of the dual roll tissue material dispensing apparatus shown in FIG. 1 with the cover removed therefrom.
Figure 3:
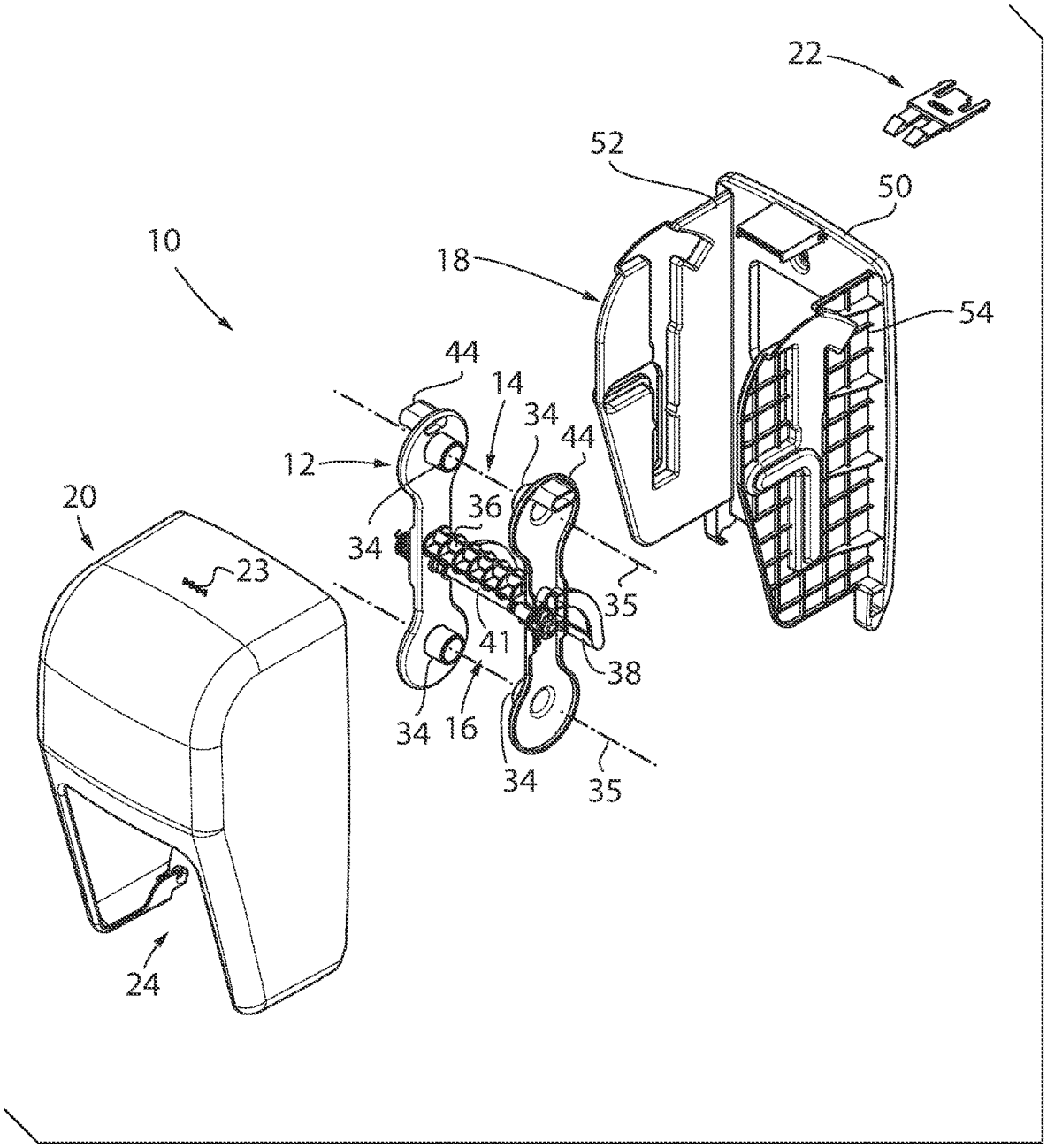
FIG. 3 is an isometric front exploded view of the dual roll tissue material dispensing apparatus shown in FIG. 1.
Figure 4:
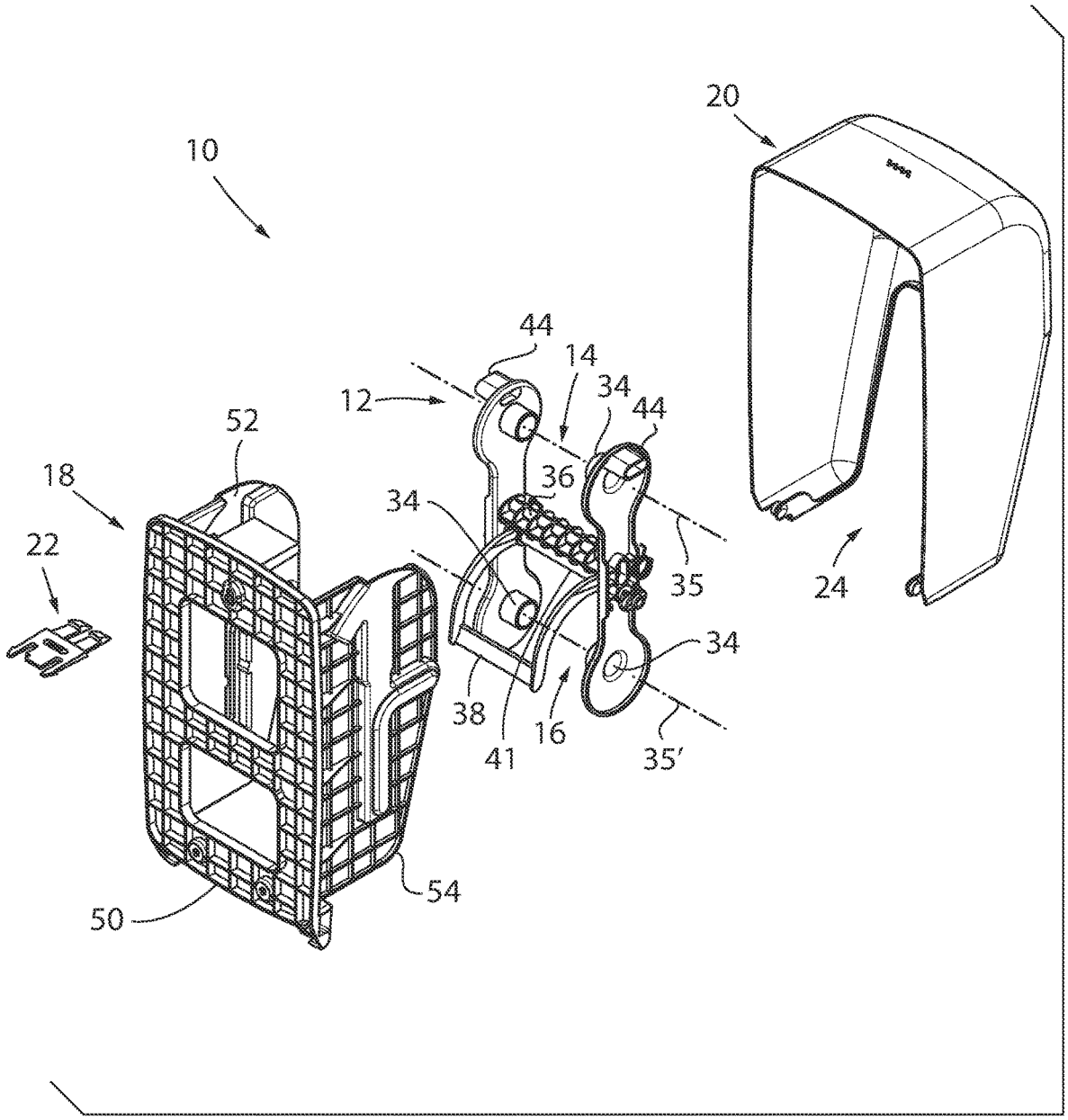
FIG. 4 is an isometric rear exploded view of the dual roll tissue material dispensing apparatus shown in FIG. 1.

In describing the preferred embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF PREFERRED EMBODIMENTS

Referring now to the drawings, and specifically to FIGS. 1-4, various isometric views of a multiple roll web or tissue material dispenser assembly, simply referred to as dispensing apparatus 10, are provided in accordance with one or more aspects of the present invention. The dispensing apparatus 10 may be a multiple roll dispenser or dispensing system that is configured to dispense a first roll of sheet material, such as toilet tissue or the like, then upon depletion of the first roll of web material, automatically actuate to allow access to dispense a second roll of material, such as another roll of tissue held within the dispensing apparatus 10, as described herein.

As disclosed further below, it should be understood that dispensing apparatus 10 shown in FIG. 1 is configured as a dual roll single column-type dispenser assembly wherein respective first and second rolls of tissue material are supported and oriented in a manner wherein the discrete rolls of tissue material are vertically oriented relative to one another and oriented such that an axis of rotation of the discrete rolls are oriented to extend in a lateral or side-to-side direction relative to dispensing apparatus 10. It is appreciated and within the scope of the appending claims that dispensing apparatus be configured to dispense rolls of tissue material in a multiple column methodology. One such configuration is disclosed further below with respect to a dispensing apparatus 10' shown in FIGS. 11 and 12 wherein the dispensing apparatus 10' is discloses as being configured to concurrently provide discrete dispensing from rolls of tissue material associated with two discrete columns of multiple rolls of tissue material. As disclosed further below, the use and operation of dispensing assemblies 10, 10' is generally the same relative to the discrete columns of multiple rolls of tissue material associated therewith.

Referring back to dispensing apparatus 10 shown in FIGS. 1-10, dispensing apparatus 10 includes a carrier, conveyor, carriage assembly, or simply carriage 12 (FIG. 5) that is configured to support respective upper 13 and lower 15 rolls of tissue material (shown in phantom in FIG. 2) that are retained at upper and lower dispensing positions 14 and 16, respectively. The carriage 12 is configured to moveably cooperate with a support frame 18 (FIG. 6) of dispensing apparatus 10 to define the relative ranges of motion of carriage 12 during use of dispenser assembly 10 to sequentially dispense discrete rolls of tissue material 13, 15 and to facilitate loading subsequent rolls of tissue material as disclosed further below.

The dispensing apparatus 10 includes a cover 20 that is configured to cooperate with support frame 18 to generally overlie carriage 12 and rolls 13, 15 associated therewith when apparatus 10 is fully assembled and configured for dispensing the tissue material therefrom. The cover 20 cooperates with support frame 18 and generally defines a majority of the exposed surfaces visible to the user of the housing or enclosure associated with enclosing the multiple rolls of tissue material 13, 15 supported by the carriage 12 when carriage 12 is engaged with support frame 18. Cover 20 can be transparent, translucent or opaque, and is typically formed of a rigid plastic material. Cover 20 is preferably moveable relative to support frame 18 between a closed position (FIG. 1) wherein the cover overlies a majority of support frame 18 and dispensing apparatus 10 is ready for dispensing of the quantity of rolled tissue material 13, 15 contained therein. When closed, cover 20 is preferably held closed by one or more locking tabs 22 (FIGS. 3 and 4) retained by the support frame 18. An opening, such as a key hole 23 (FIG. 1), is preferably formed through cover 20 and shaped to receive a key constructed to interact with tabs 22 to effectuate selective unlocking of cover 20. Once unlocked, cover 20 rendered moveable and preferably pivotable relative to support frame 18 to be rotatable in a forward and downward direction toward an open position (FIGS. 9 and 10) associated with configuring dispensing apparatus 10 ready for loading of carriage 12 with subsequent rolls of tissue material.

Cover 20 and/or support frame 18 cooperate with one another to define a dispensing area 24 that is preferably positioned proximate a lower front portion of dispenser apparatus 10 and that allows a user access to tissue rolls 13, 15 contained therein when cover 20 is in the closed position. Dispense area 24 is preferably large enough and/or cooperates with the translucent or transparent nature of a portion of cover 20 such that users and service personnel can readily ascertain the availability of tissue material associated with one or each of rolls 13, 15 from less immediate proximity thereto. As disclosed further below, dispensing of tissue rolls 13, 15 is performed sequentially such that lower roll 15 is dispensed first and, only when lower roll 15 is sufficiently and preferably fully depleted, the position of upper roll 13 is automatically translated relative to apparatus 10 such that upper roll 13 achieves a position relative to dispensing area 24 that upper roll 13 is rendered accessible for dispensing. During loading and dispensing events, cover 20 is preferably configured to pivot about an axis 26 (FIGS. 7-10) defined by a pivot point relative to the support frame 18 so that cover 20 remains engaged with or otherwise attached to the support frame 18 during movement of the cover 20 between the open and closed positions. Such a consideration frees both hands of service personnel during service operations such that reloading of dispersing apparatus 10 can be executed in an expeditious manner.

In one aspect, the carriage 12 (FIG. 5), is preferably formed of a plastic material, and can comprise first and second arms 30 and 32, respectively, configured to support the upper and lower rolls of tissue material therebetween. Interiors of the first and second arms 30 and 32, respectively, can each include spindle or support points 34 at the upper and lower dispensing positions 14 and 16 for supporting the upper and lower rolls of web material. Respective upper and lower sets of roll bosses or support points 34 are aligned with one another and are oriented to define respective axis of rotation 35, 35' associated with the discrete rolls of tissue material 13, 15 engaged therewith. The first and second arms 30 and 32, respectively, may be joined by an intermediary bar 36 which connects each of the first and second arms 30 and 32, at approximate interior lateral midpoints thereof. In a preferred embodiment, each of first and second arms includes a laterally outboard facing reinforcement or boss 46 constructed to cooperate with one or more fasteners or a snap-fittable engagement associated with securing the respective opposite lateral ends of intermediary bar 36 relative to the respective first and second arms 30, 32 in a secure and robust manner.

As disclosed further below, respective longitudinal ends of arms 30, 32 are preferably resiliently deflectable in generally opposite lateral outward directions generally aligned with the respective discrete roll rotation axis 35, 35' to facilitate engagement of discrete rolls of tissue material with respective aligned support points 34 during loading operations. The lateral outward deflection of arms 30, 32 is an intuitive tissue roll loading operation and a manipulation that is rendered unavailable when dispensing apparatus 10 is closed and/or carriage 12 is positioned for dispensing operation relative to support frame 18. Such a consideration mitigates incidents of theft of unconsumed rolls or portions of rolls of tissue material from dispensing apparatus 10 when it is deployed in a service environment. Further, the offsetting of axis 35 relative to axis 35' and the placement of intermediary bar 36 between disposed therebetween and between the discrete rolls 13, 15 associated with carriage 12 mitigates interaction and transference between tissue rolls 13, 15 during dispense events thereby further protecting the sanitary condition of the discrete rolls of tissue as well as the operational integrity of dual roll dispensing apparatus 10.

As alluded to above, dispensing apparatus 10 is preferably constructed to limit access to the upper or second to be dispensed roll of tissue material 13 until the lower or first to be dispensed roll of tissue material 15 has been consumed or otherwise sufficiently depleted—such as only a core or a cigar associated with the recently depleted roll being present or associated with the respective support points 34 associated with axis 35'. An actuator assembly 37 is supported by carriage 12 includes an actuator arm or loading bar 38 and a biasing device such as a spring 40 or the like. The spring 40, which may be a torsion spring, biases the loading bar 38, which may be a torsion bar, against the radially outer surface of lower roll of tissue material 15 associated with the lower dispensing position 16. The actuator assembly includes a follower, actuator follower, or retention member 42 that is connected to a laterally outboard end of a shaft 41 associated with loading bar 38 and disposed toward at least one outboard lateral side of carriage 12. Shaft 41 and retention member(s) 42 of the actuator assembly are attached to loading bar such that rotation of loading bar 38 in response to depletion of lower roll 15 of tissue material effectuates rotation of shaft 41 and the retention member(s) 42 associated therewith.

As disclosed further below, retention member 42 is configured to selectively slidably cooperate with or operatively engage with a respective groove or channel 68 defined by support frame 18. The retention member 42 could be configured as a lobe, cam, oblong shape or similar follower for travel through a channel in a first orientation and interfering with one or more stops that are defined by channel 68 when oriented thereat and traversing there past to achieve a second lowered orientation of carriage 12 relative to support frame 18 and which is associated with allowing user access to the upper positioned roll of tissue material 13 when necessary. It is appreciated that actuator assembly 37 could be provided with one retention member 42 that slideably cooperates with a respective channel 68 to effectuate the desired relative raised and lowered positions therebetween. In a preferred embodiment, each of the opposite lateral sides of carriage 12 and actuator assembly 37 includes a retention member 42 that cooperates with a corresponding channel or groove 68 that is defined by the respective sidewall 52, 54 positioned proximate thereto. Such a consideration mitigates wracking or twisting of carriage 12 relative to support frame 18 so as to maintain the desired slideable operation therebetween.

Figure 5:
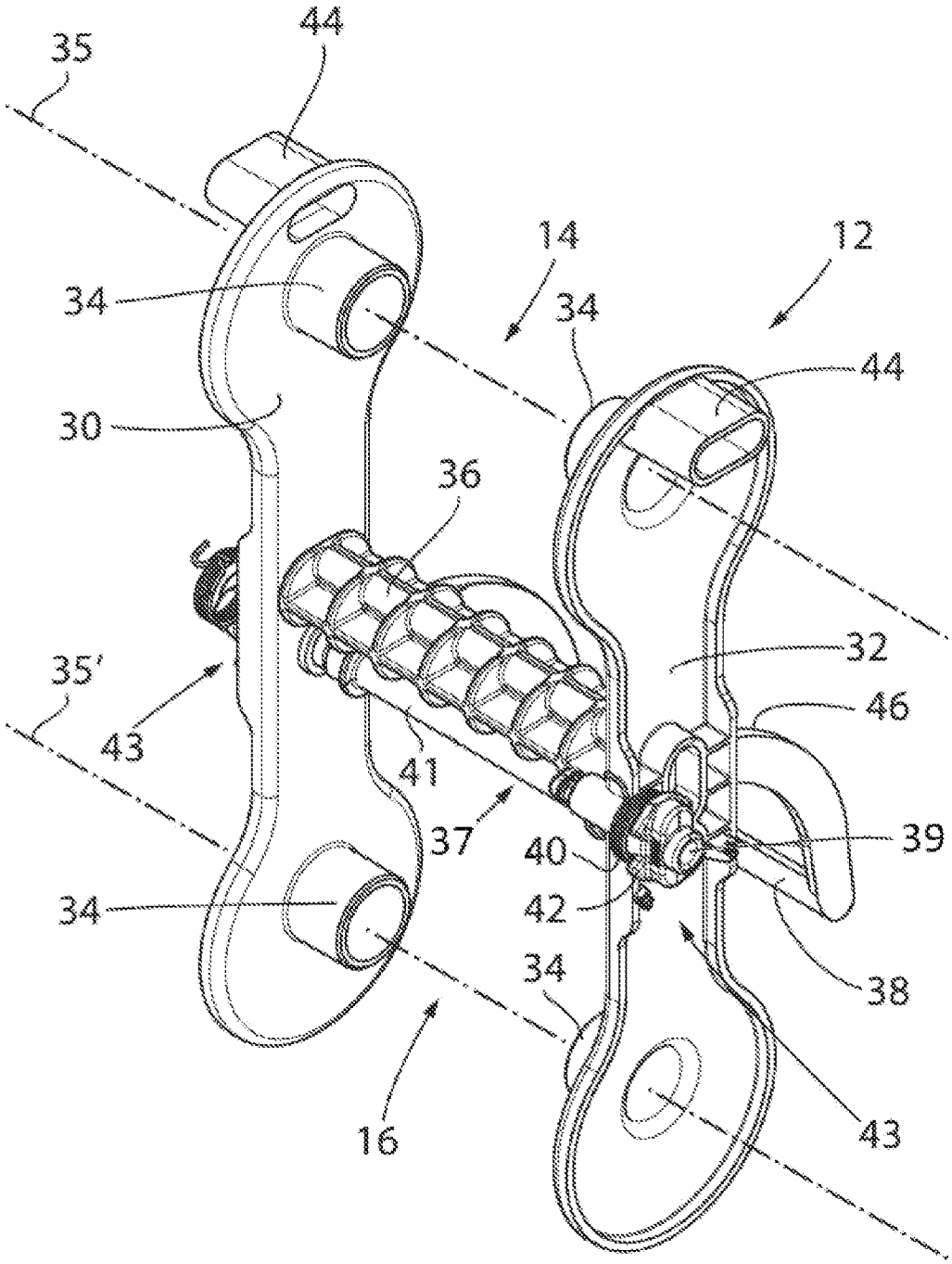
FIG. 5 is an isometric front view of a carriage assembly of the dual roll tissue material dispensing apparatus shown in FIG. 1.
Figure 6:
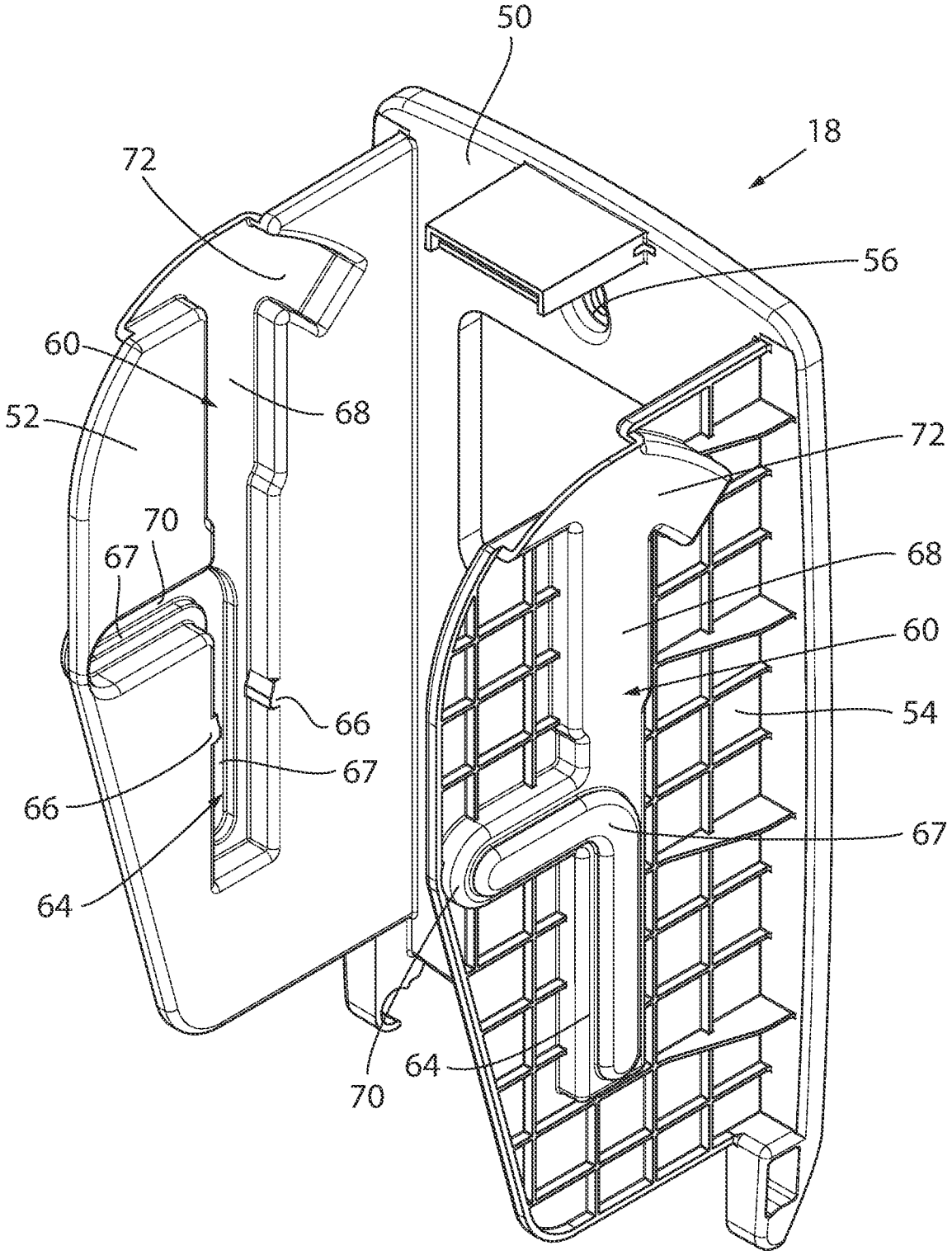
FIG. 6 is an isometric front view of a support frame of the dual roll tissue material dispensing apparatus of FIG. 1.

As shown in FIGS. 5 and 6, respective retention members 42 can be arranged on the opposite lateral outer peripheries 43 of the first and/or second arms 30 and 32 of carriage 12, respectively, and cooperate with respective grooves or channels 68 defined by the laterally inboard facing surfaces of respective sidewalls 52, 54 of support frame 18. Each retention member 42 is secured to a shaft 39 of actuator assembly 37 having loading bar 38 extending in an outward radial direction therefrom. Torsion spring 40 acts to bias loading bar 38 toward axis 35' associated with lower roll of tissue material 15 and to effectuate rotation of shaft 39 about its axis, and thereby rotation of retention members 42 secured to the opposing ends of shaft 39, relative to the respective channels with which they are slidably associated. Such a construction allows the retention member 42 to actuate, such as by rotating, between the aforementioned first and second orientations as determined by corresponding positions of the loading bar 38 relative to carriage 12 and more particularly the lower roll of tissue material 15 supported thereby. The carriage 12 can also preferably include a first set of guides or protrusions 44 that facilitate guided slideable vertical (up and down) and rotational movement, and a second set of guides defined by retention members 42 and which facilitate both vertical and horizontal movement (fore and aft translation of carriage 12 relative to a rear wall or mount base 50 of support frame 18) and rotational manipulation of carriage 12 relative support frame 18, when each are operatively engaged with a respective sidewall channel of the support frame 18.

Figure 11:
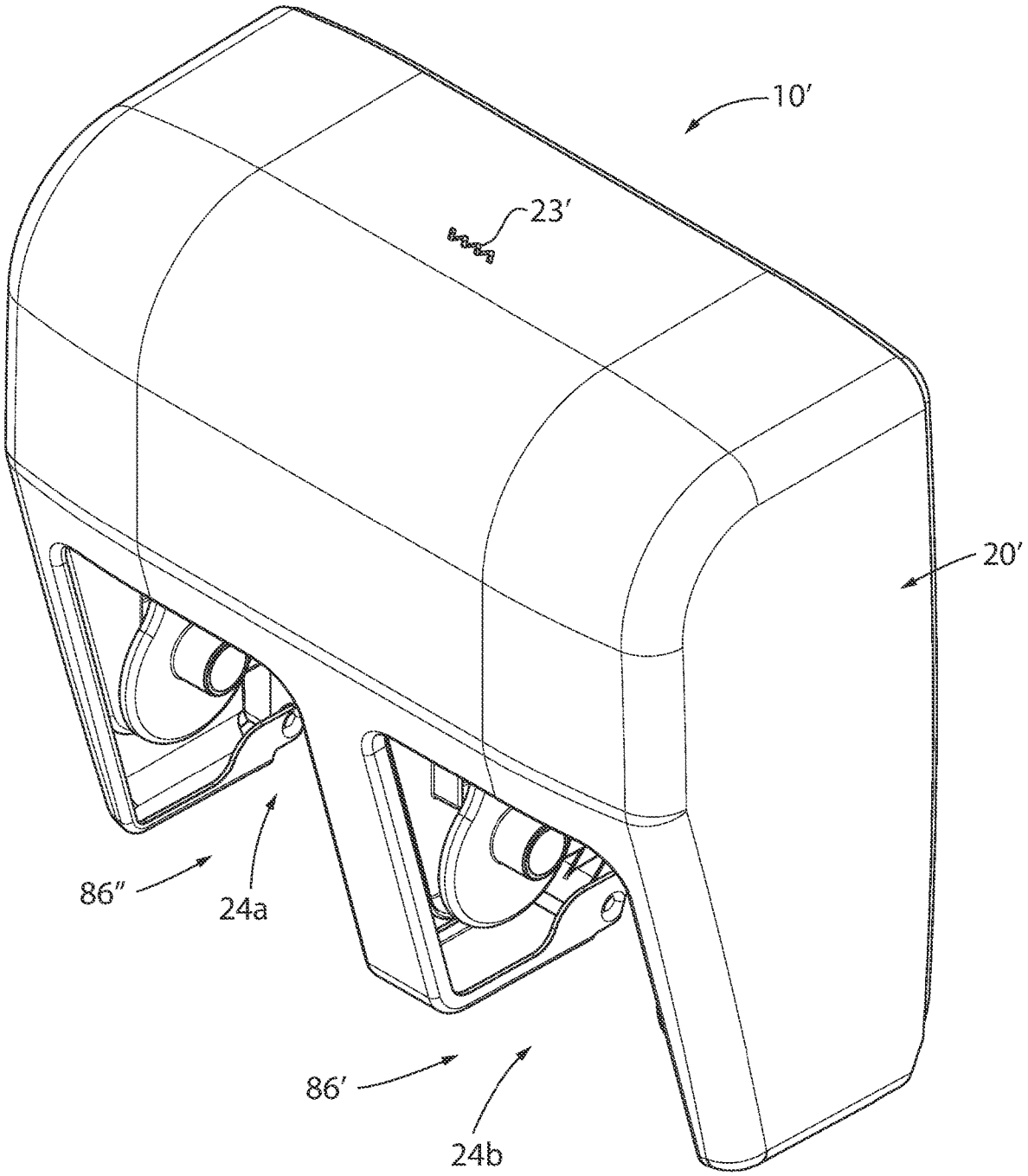
FIG. 11 is an isometric front view of a dual column/dual roll tissue material dispensing apparatus in accordance with another aspect of the present invention.
Figure 12:
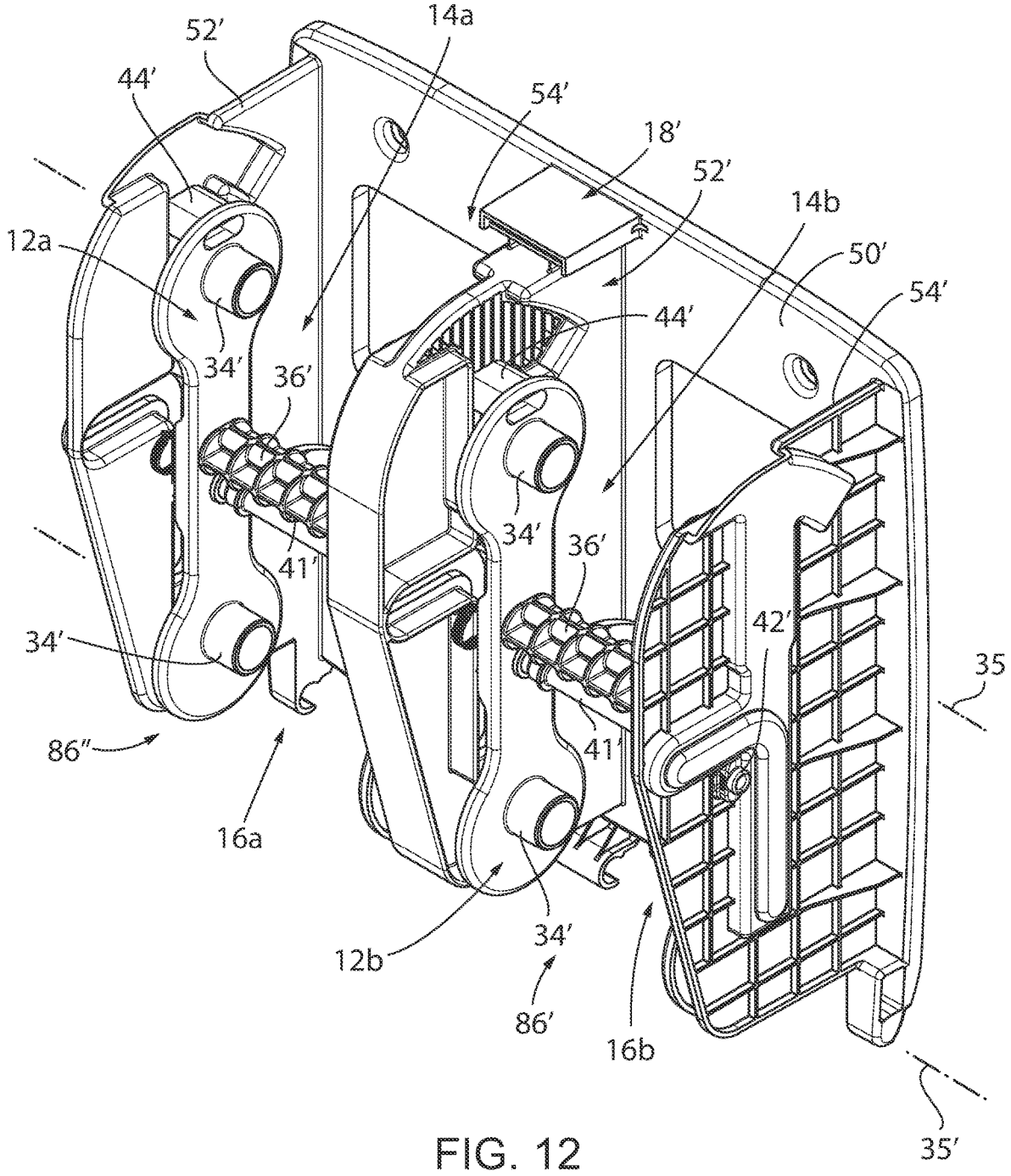
FIG. 12 is an isometric front view of the web material dispensing apparatus of FIG. 11 wherein a cover has been removed therefrom.

Referring to FIG. 6, in one aspect, support frame 18 is typically formed of a plastic material and generally defines a unitary one-piece construction that includes a rear wall or mount base 50 and opposing sidewalls 52 and 54 that extend in a common outward crossing direction from the generally opposite lateral edges thereof It is further appreciated that sidewalls 52, 54 could be constructed to snap-fittingly cooperate with base 50 when support frame 18 and dispensing apparatus 10 is intended to be deployed. Base 50 preferably includes one or more apertures 56 for mounting to a wall or other surface. The opposing sidewalls 52 and 54 can each include a series of interconnected sections of channel 60 (and/or sub-channels) that are oriented to effectuate guided motion of carriage 12 relative to support frame 18 between the various dispense lower roll, dispense upper roll, load lower roll, load upper roll, and transition between lower roll consumed to upper roll dispensing positions. It should be further appreciated that channels 60 associated with sidewalls 52, 54 are generally mirror images of one another relative to a vertical plane associated with the vertical centerline plane of dispensing apparatus 10 as are the respective lateral outboard structures of carriage 12 associated with protrusions 44 and retention member 42. It is further appreciated that support frame 18' associated with dispensing assembly 10' as shown in FIGS. 11 and 12 and as disclosed further below could be constructed in accordance with other methodologies in addition to those disclosed above so as to define a respective support frame 18' with a generally centrally disposed partition and opposing sidewalls or other removable wall methodologies.

In a preferred embodiment, each of channels 60 defines a continuous generally uninterrupted follower path or channel that includes: a lower vertical section of channel 64, respective stops 66 associated therewith, an upper vertical section of channel 68, a horizontally oriented section of channel 70, and an upper oriented section of actuate channel 72. The respective sections of channels 64, 68, 70, 72 are generally fluidly continuous with one another and oriented to slideably interact with one or more of protrusions 44 and the retention members 42. The vertically upper located protrusions 44 have a fixed shape and orientation and slideably cooperate with channel sections 68, 72 so as to not interfere with the range of vertical translation of carriage 12 relative to support frame 18 when engaged therewith. Retention members 42 are oriented proximate the axis defined by intermediary bar 36 and slideably cooperate with sections of channel 64, 70 to accommodate the vertical translation of carriage 12 relative to support frame 18 and to facilitate the selective rotation of carriage 12 to accommodate the loading operations.

In a preferred embodiment, a curved section of sub-channel 67 is formed to extend in the lateral crossing direction relative to support frame 18 and is generally embedded through the lower vertical channel 64 and the horizontal channel 70 and is oriented to receive and slideably cooperated with a head portion of respective retention member 42 associate with carriage 12. Retention members 42 are generally defined by a major dimensional cross section and a minor dimensional cross section that are oriented at crossing orientations relative to one another.

Retention members 42 interact with stops 66 defined by channels 60 to selectively limit the downward vertical translation of carriage 12 relative to support frame 18. When the major dimensional axis of retention members 42 are oriented in a crossing direction relative to channel 60, associated with the outward rotational orientation of loading bar 38 relative to axis 35' defined by lower roll of tissue material 15, retention member(s) 42 impinge upon stop 66 and prevent further downward slideable translation of carriage 12 relative to support frame 18. During consumption of lower roll of tissue material 15, loading bar 38 is urged toward axis 35' via spring 40 and thereby effectuates rotation of retention member(s) 42 relative to stops 66. Upon consumption of lower roll of tissue material 15, retention member(s) 42 attain an orientation wherein the minor cross sectional dimension axis of retention member(s) 42 is oriented at a crossing direction relative to stops 66 such that retention member(s) 42 are allowed to slideably translate past stops 66 such that carriage 12 achieves a lowered orientation or position relative to support frame 18 such that a tail end of upper roll of tissue material 13 is accessible at dispensing area 24 for subsequent dispensing of upper roll 13 of tissue material.

Figure 7:
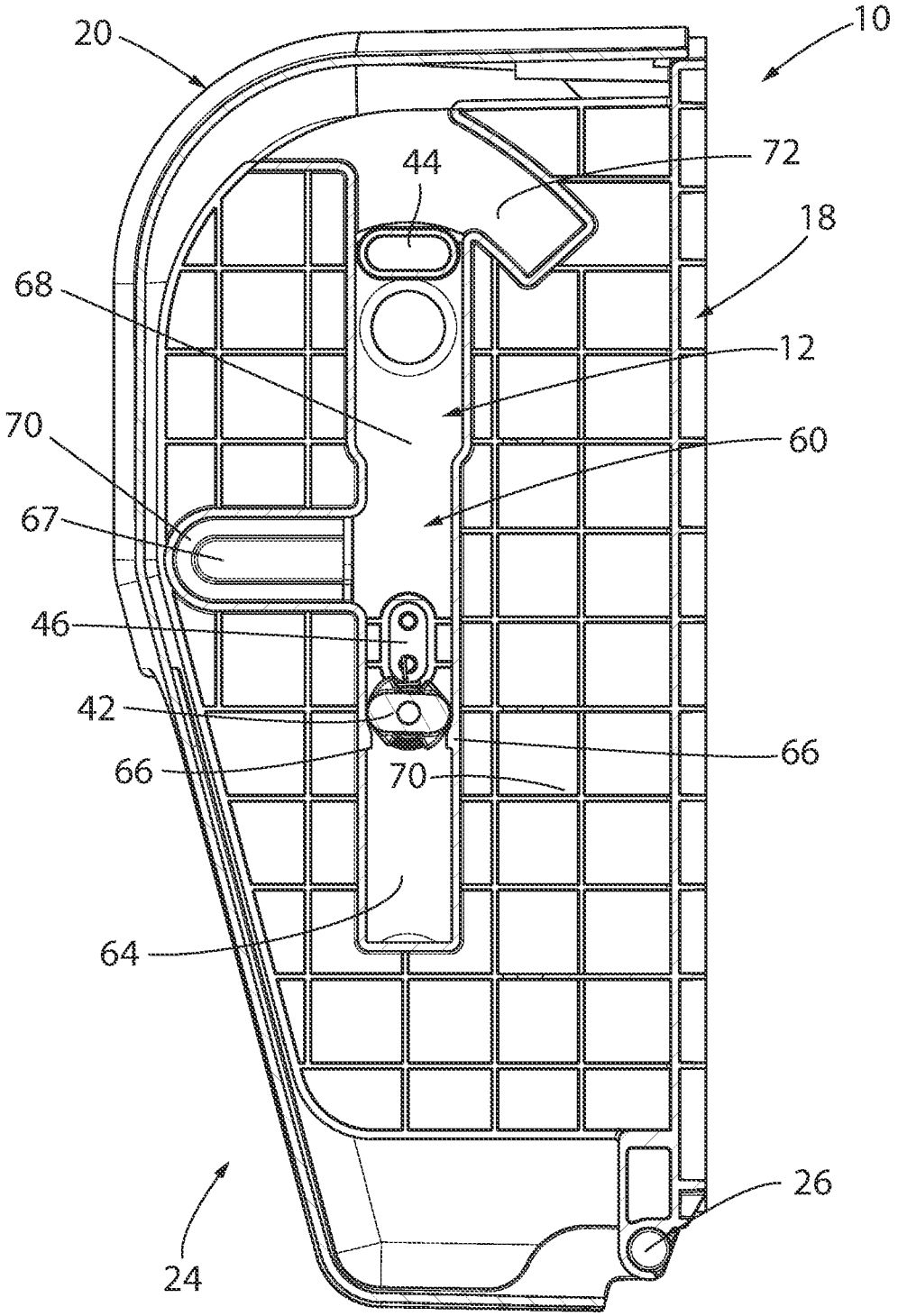
FIG. 7 is a cutaway side elevation view of the dual roll material dispensing apparatus of FIG. 1 with the cover oriented in a closed position and the carriage assembly as shown is FIG. 5 oriented a first or raised position for dispensing a lower roll of tissue material.

As shown in FIG. 7, a cutaway side view of the dispensing apparatus 10 in which the cover 20 is in the closed position and in which the carriage 12 is in a first dispensing position comprising a raised orientation for dispensing the lower roll of web material 15 from the lower dispensing position 16 through the dispensing area 24 is provided in accordance with an aspect of the invention. In the first position, the cover 20 conceals the upper roll of web material at the upper dispensing position 14 while exposing the lower roll of web material at the lower dispensing position 16. Presence of the lower roll of web material 15 actuates the retention member 42 into a holding orientation, via the loading bar 38 and the spring 40, which extends lengthwise such that the retention member 42 is kept or held in the first elevational position by the stops 66. Also, the upper vertical channel 68 engages the first set of protrusions 44 so as to steady the positional association of carriage 12 relative to support frame 18. The first position is maintained while dispensing of the lower roll of web material 15 occurs with the upper roll of web material 13 remains concealed by the cover 20 within the dispensing apparatus 10.

Figure 8:
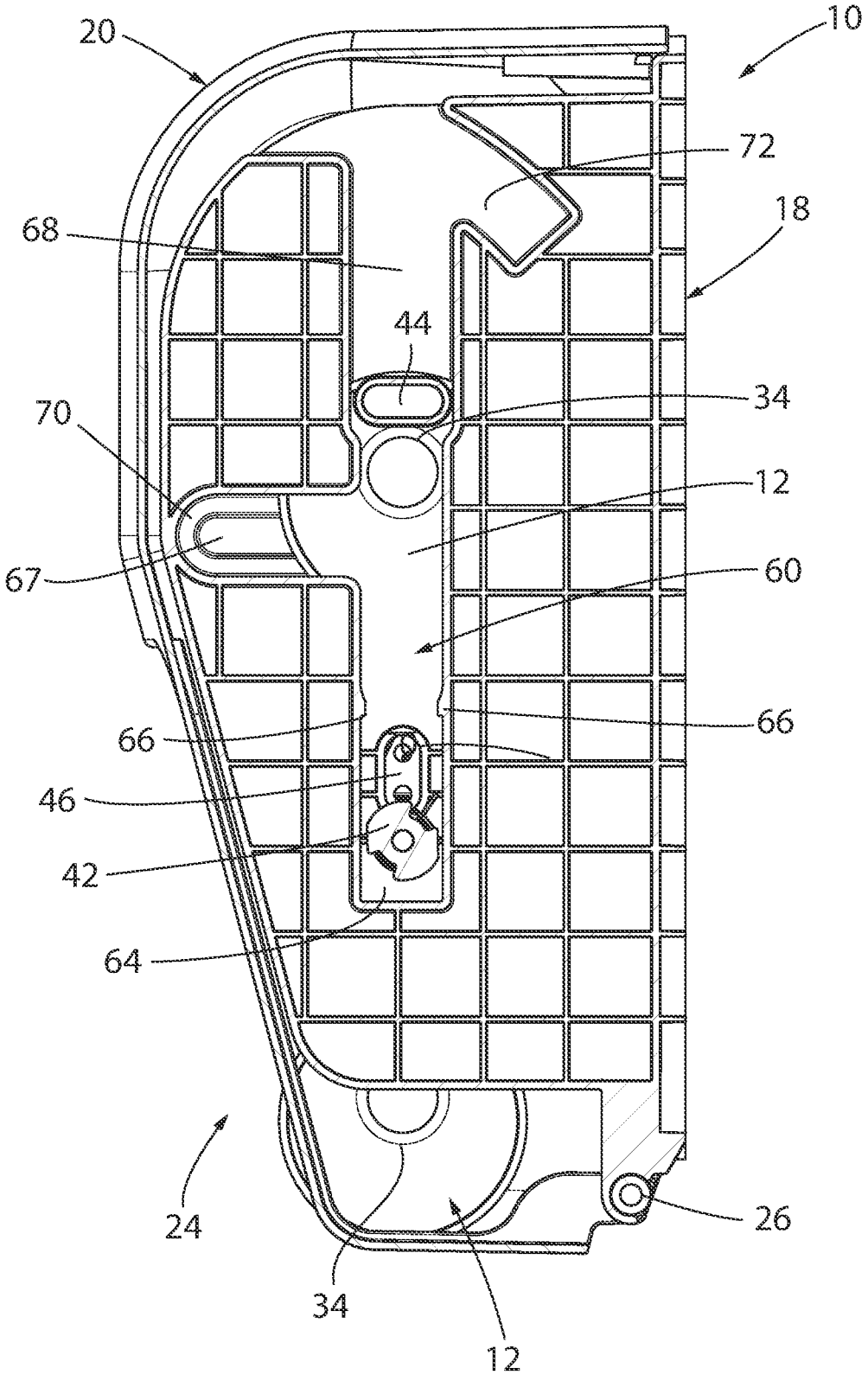
FIG. 8 is a view similar to FIG. 7 and shows the carriage assembly in a second or lowered position associated with dispensing an upper roll of tissue material.

Referring now to FIG. 8, a cutaway side view of the dispensing apparatus 10 in which the cover 20 is in the closed position and in which the carriage 12 is in a second vertical position or orientation comprising a vertically lowered position for dispensing the upper roll of web material 13 from the upper dispensing position 14 through the dispensing area 24 is provided in accordance with an aspect of the invention. In operation, the carriage 12 is configured to move from the first vertical dispensing position (FIG. 7) to the second vertical dispensing position (FIG. 8) when the lower roll of web material is depleted. Absence of the lower roll of web material 15, or being empty, actuates the retention member 42 into a movement orientation, via the loading bar 38 and the spring 40, to rotate retention member(s) 42 to an orientation wherein they are allowed to move beyond the stops 66 such that carriage 12 is allowed to drop down relative to support frame 18. The upper vertical channel 68 guides the first set of protrusions 44, the lower vertical channel 64 guides the retention member 42, into the second vertical dispensing position. Accordingly, movement of the loading bar 38 causes automatic actuation of the retention member 42 between the aforementioned upper dispensing and lower dispensing orientations, and correspondingly, the aforementioned selective sequential dispensing positions. In the second vertically lowered position, the cover 20 exposes at least a bottom portion of the upper roll of web material 13 (at the upper dispensing position 14). The second position is maintained while dispensing of the upper roll of web material occurs.

Figure 9:
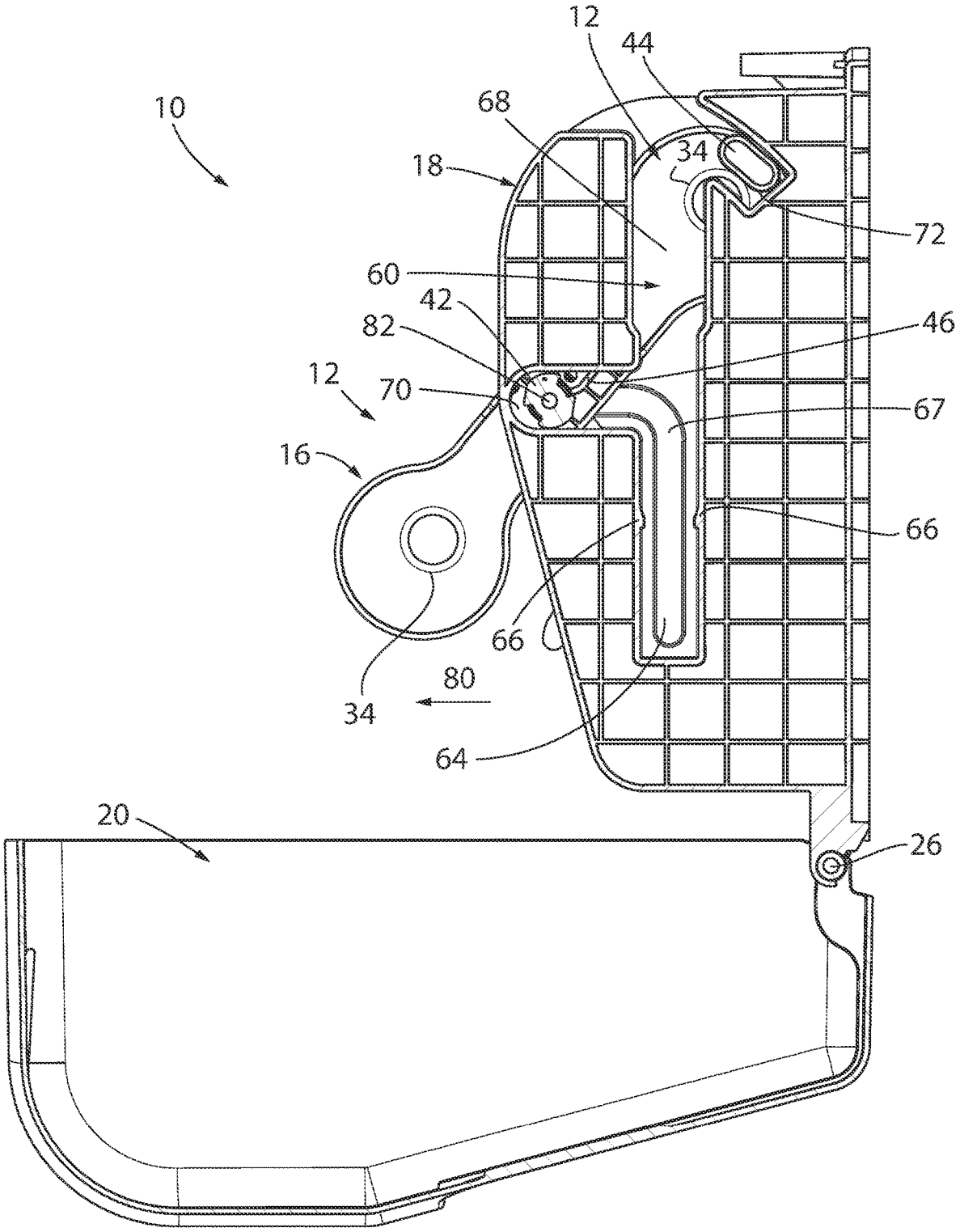
FIG. 9 is a view similar to FIG. 7 and wherein the cover is oriented in an open position and in which the carriage is oriented in a third position associated with loading of a lower roll of tissue material.

Referring now to FIG. 9, and upon depletion of the upper and lower rolls of tissue material 13, 15, a side view of the dispensing apparatus 10 in which the cover 20 is oriented in an open position and in which the carriage 12 is in a third position and pivoted in a first direction for loading a lower roll of web material (at the lower dispensing position 16) is provided in accordance with an aspect of the invention. In operation, typically after the upper roll of web material is also depleted, the carriage 12 is raised up to alignment between retention members 42 and the horizontal section of channel 70 and brought forward through the horizontal section of channel 70 into a lower roll loading position. Accordingly, the horizontal channel 70 guides the second set of protrusions defined by retention member(s) 42 into the third position relative to support frame 18. Upon being urged forward, such third position becomes out of plane relative the aforementioned first and second positions (FIGS. 7 and 8) of carriage 12 relative to support frame 18. Being pulled forward facilitates outward lateral deflection of the respective exposed ends of arms 30, 32 to facilitate sequential loading of discrete rolls of tissue material.

Figure 10:
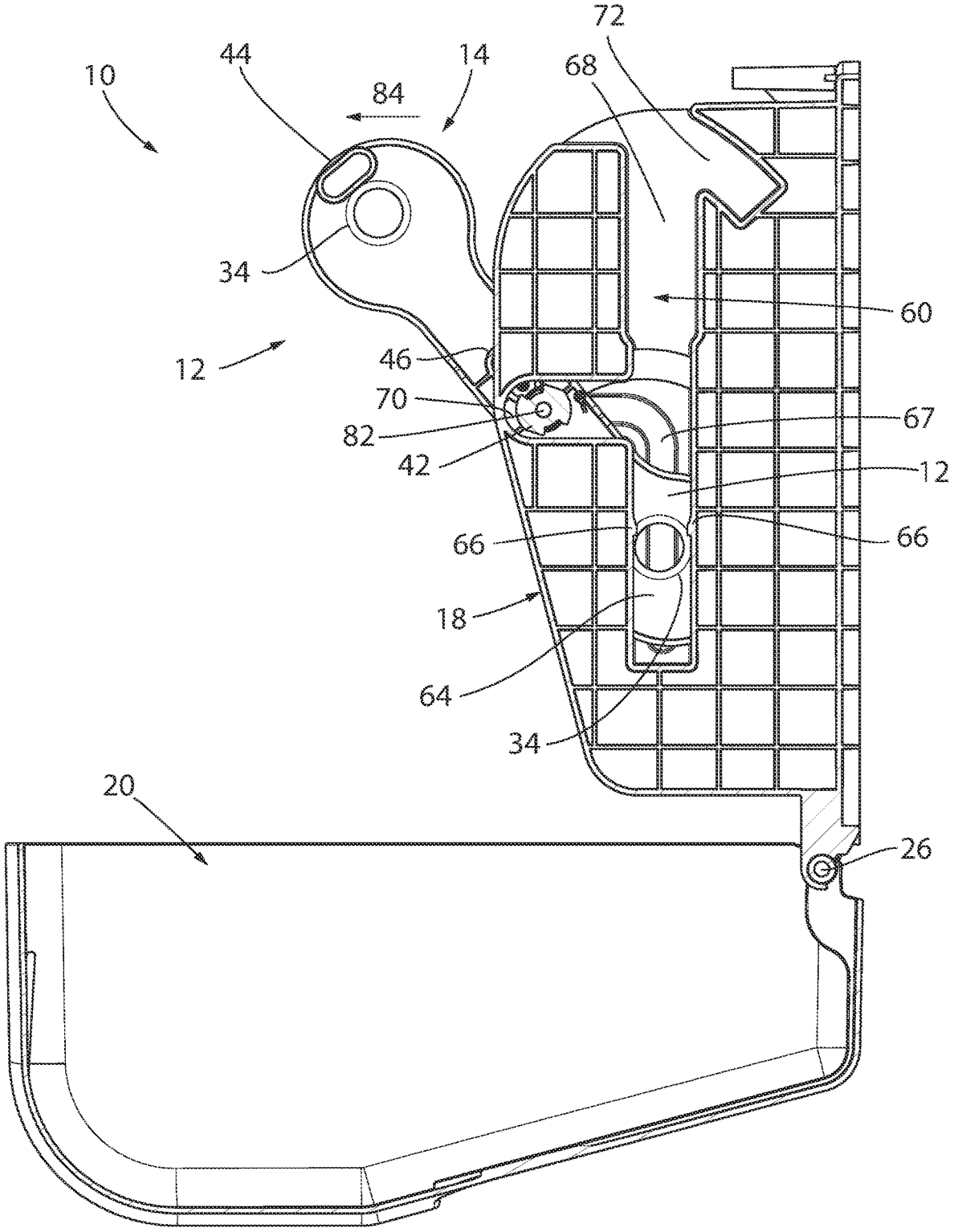
FIG. 10 is a view similar to FIG. 9 wherein the carriage is pivoted in an opposing direction relative to the orientation shown in FIG. 9 and is positioned for loading an upper roll of tissue material.

Referring to FIGS. 9 and 10, and in no particular order, the upper and lower rolls of web material can be individually loaded when carriage 12 is oriented in the third position relative to support frame 18. Referring first to FIG. 9, the carriage 12 can pivot in a first direction 80, from the bottom of the carriage 12, about a central axis 82 relative to the carriage 12 for loading the lower roll of web material at the lower dispensing position 16 (FIG. 9). The central axis 82 may be defined by the retention member 42 in a forward most position of the horizontal channel 70. In other words, the bottom of the carriage 12 can be rotated to bring the bottom of the carriage 12 outward to effectuate loading of the bottom tissue roll. Referring next to FIG. 10, in the third position, the carriage 12 can pivot in a second direction 84 opposite the first direction 80, from the top of the carriage 12, about the central axis 82 relative to the carriage 12 for loading the upper roll of web material at the upper dispensing position 14 (FIG. 10). The upper arcuate channel 72 guides the first set of protrusions 44 when loading the upper roll of web material in the third position. In other words, after the bottom tissue roll is loaded, the carriage can be rotated to bring the top of the carriage forward to effectuate loading of the top roll of tissue material. Upon loading of the upper and lower rolls of tissue material, carriage 12 can be rotated toward a vertically upright orientation until retention member(s) 42 and protrusions 44 are aligned with the generally vertical portions of channel 60 associated with the relative orientations shown in FIG. 7. Upon closing cover 20, dispensing apparatus 10 is again configured to sequentially dispense the respective rolls of tissue material 13, 15 engaged with carriage 12. As disclosed above, upon roll of tissue material 13 is rendered obscured and generally inaccessible until depletion of lower roll of tissue material 15 during each successive loading and consumption cycle.

As alluded to above, although dispensing apparatus 10 is disclosed as sequentially dispensing two vertically stacked rolls of tissue material, it is appreciated that the apparatus can be conveniently configured to dispense other numbers of rolls of vertically oriented tissue material. Referring now to FIGS. 11 and 12, where like numerals refer to like parts throughout, isometric front views of a web material dispensing apparatus 10' are provided in accordance with another aspect of the present invention. Dispensing apparatus 10' is constructed to accommodate first and second carriages 12*a* and 12*b* that are each independently operable in the manner disclosed above and configured to mount to a widened or doubled support frame 18', with a correspondingly widened or doubled cover 20', in a side by side arrangement. That is, whereas dispenser apparatus 10 includes a single dual roll dispensing cavity 86, dispenser apparatus 10' includes a pair of similarly operable dual roll dispensing cavities 86', 86". As a result, the dispensing apparatus 10' can operate to simultaneously hold at least four rolls of web material (not shown), namely, upper and lower rolls of web material retained at upper and lower dispensing positions 14*a* and 16*a*, respectively, by the first carriage 12*a*, and upper and lower rolls of web material retained at upper and lower dispensing positions 14*a* and 16*a*, respectively, by the second carriage 12*b*. In addition, the dispensing apparatus 10' can simultaneously dispense at least two of the at least four rolls of web material through first and second dispensing areas 24*a* and 24*b*, respectively, namely, the lower roll of web material (at the lower dispensing position 16*a*) of the first carriage 12*a* and the lower roll of web material (at the lower dispensing position 16*a*) of the second carriage 12*b*. Although only two such dual roll dispensing columns are shown, it is further appreciated that other numbers of dual roll dispensing columns can be similarly provided.

Advantageously, when the lower roll of web material of either the first carriage 12*a* or the second carriage 12*b* empties or is depleted, each individual carriage can move independently from the first vertical dispense position (FIG. 7) toward the second vertical dispense position (FIG. 8) while the other carriage remains in a respective one of the first vertical dispense position (FIG. 7) or second vertical dispense position (FIG. 8) as a condition of the availability of tissue material associated with the lower oriented roll unique to the discrete column of multiple rolls of tissue material. The first and second carriages 12*a* and 12*b* are allowed to move between the aforementioned discrete dispensing positions independently of each other or the position of any other carriages associated with the discrete dispensing apparatus. It is appreciated that dispensing apparatus 10, 10' can be configured to accommodate applications wherein the volume of tissue material consumed between service events varies greatly and/or to reduce the frequency associated with such service events. Each of dispensers 10, 10' provide sequential dispensing of multiple rolls of tissue material wherein consumption of one roll of tissue material is required to effectuate access to a subsequent roll of material supported by the apparatus. Yet to be accessible rolls of tissue material are maintained in a secure and sanitary manner to prevent premature access and/or exposure of the same to the use environment. Still further, advancement for dispensing of onboard supported or stowed rolls of tissue material is effectuated in an automatic methodology or methodology that requires no action on behalf of the consumer so as to mitigate instances of damage to the dispensing apparatus, partial consumption of multiple rolls, and/or theft or other nefarious interaction with yet to be accessible rolls of tissue material whether provided in the single or multiple column configurations.

The dispenser of the present invention may have other applications aside from use with rolls of tissue material, such as but not limited to tissue paper, hand towel, and toilet paper. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims. The present invention has been described in terms of the preferred embodiment, and it is recognized that equivalents, alternatives and modifications, aside from those expressly stated, are possible and within the scope of the appending claims.

What is claimed is:

1. A dispenser assembly configured to dispense multiple rolls of tissue material, the dispenser assembly comprising:

a carriage configured to support multiple rolls of tissue material;

a support frame constructed to receive the carriage so that the carriage is selectively slideable relative to the support frame between a first orientation wherein a lower roll of tissue material is available to be dispensed and a second orientation wherein an upper roll of tissue material is available to be dispensed;

a follower path defined by the support frame;

an actuator supported by the carriage and oriented to engage a roll of tissue associated therewith;

a follower connected to the actuator and oriented to cooperate with the follower path so that the follower is rotatable relative to the follower path to selectively allow the carriage to move from the first orientation toward the second orientation relative to the support frame in response to rotation of the actuator; and wherein the carriage is configured to move to a third orientation relative to the support frame, the third orientation defining a loading position for loading one of the upper and lower rolls of web material, the third orientation allowing respective free ends of the carriage to be positioned out of plane relative the first and second orientations.

2. The dispenser assembly of claim 1 further comprising a biasing device disposed between the actuator and the carriage that is operable to bias the actuator in a direction toward an axis of rotation defined by the lower roll of tissue material.

3. The dispenser assembly of claim 2 wherein the carriage further comprises a first arm and a second arm that are each configured to support opposing ends of each of the lower roll of tissue material and upper roll of tissue material.

4. The dispenser assembly of claim 3 wherein the follower is disposed on a laterally outward facing side of at least one of the first arm and the second arm of the carnage.

5. The dispenser assembly of claim 3 further comprising a shaft that extends between the first arm and the second arm proximate the actuator.

6. The dispenser assembly of claim 1 wherein the support frame further comprises another follower path having a mirror image shape of the follower path and another follower is connected to the actuator opposite the follower and oriented to cooperate with the another follower path defined by the support frame.

7. The dispenser assembly of claim 1 wherein, in the third orientation, the carriage is configured to pivot in a first direction about a lateral axis defined by an axis of rotation of the follower for loading one of the upper and lower rolls of tissue material.

8. The dispenser assembly of claim 7 wherein the carriage is configured to move to a fourth orientation relative to the support frame by pivoting the carriage in a second direction about the lateral axis relative to the support frame for loading the other of the upper and lower rolls of tissue material.

9. The dispenser assembly of claim 8 wherein the carriage further comprises a protrusion configured to selectively engage and disengage from a portion of the follower path of the support frame to facilitate pivoting of the carriage relative to the support frame in the respective first direction and second direction.

10. The dispenser assembly of claim 1 further comprising a cover connected to the support frame and moveable between an open position and a closed position, wherein the cover is configured to conceal the upper roll of tissue material while exposing the lower roll of tissue material when the carriage is in the first orientation and expose at least a portion of the upper roll of tissue material when the carriage is in the second orientation.

11. The dispenser assembly of claim 10 wherein the cover is configured to pivot relative to the support frame between the open position for loading the upper and lower rolls of tissue material and the closed position for dispensing the upper and lower rolls of tissue material.

12. The dispenser assembly of claim 1 further comprising another carriage having another actuator and another follower, the support frame defining another follower passage having a same shape as the follower passage and constructed to slideably cooperate with the another follower so that the another carriage is constructed to support multiple rolls of tissue material in a same manner as the carriage and the support frame is constructed to concurrently support the carriage and another carriage such that the carriage and another carriage are independently moveable relative to the support frame so that the carriage and another carriage cooperate with the support frame in a side-by-side orientation and the dispenser assembly is capable of simultaneously holding at least four rolls of tissue material and simultaneously dispensing at least two of the at least four rolls of tissue material.

13. A dispensing apparatus comprising:

a support frame having at least one channel;

a carriage configured to hold upper and lower tissue rolls, the carriage constructed to cooperate with at least one channel defined the support frame such that the carriage is automatically moveable relative to the support frame between an upper position and a lower position;

an actuator supported by the carriage and oriented to interact with the lower tissue roll and cooperate with the at least one channel such that rotation of the actuator relative to the carriage allows translation of the carriage relative to the support frame from the upper position toward the lower position and while the actuator remains associated with the at least one channel through translation of the carriage relative to the support frame; and a cover connected to the support frame and configured to obstruct access to an upper tissue roll when the carriage is the in the upper position and allow access to a portion of the upper tissue roll when the carriage is oriented in the lower position.

14. The dispensing apparatus of claim 13 further comprising an operator connected the actuator that cooperates with the at least one channel, the operator being rotatable between a first orientation configured to retain the carriage in the upper position and a second orientation that allows the carriage to move toward the lower position without outside interference.

15. The dispensing apparatus of claim 13 wherein the support frame is further defined by opposing side walls and the at least one channel is defined by a respective side wall and another channel having a mirror image construction of the at least one channel is defined by another respective side wall.

16. The dispensing apparatus of claim 13, wherein the cover is configured to pivot about an axis relative to the support frame between an open position for loading the upper and lower rolls of web material and a closed position for dispensing the upper and lower rolls of web material.

17. The dispensing apparatus of claim 13, wherein the support frame defines a first dual roll cavity configured to receive the carriage configured to hold upper and lower tissue rolls and a second dual roll cavity configured to receive another carriage configured to hold another upper and lower tissue rolls, the support frame including another channel oriented to support the another carriage so that the another carriage is slideable relative to the support frame independent of the carriage associated with the first dual roll cavity and such that the dispensing apparatus is configured to simultaneously hold at least four tissue rolls and simultaneously dispense only one roll of tissue rolls associated with the first dual roll cavity and the second dual roll cavity.

18. A method for forming a multiple roll tissue dispenser assembly, method comprising:

providing a carriage for supporting multiple rolls of tissue material in a vertically stacked orientation wherein the carriage defines an axis of rotation of each discrete roll of tissue material;

attaching the carriage to a support frame so that the carriage is slideable between a first position and a second position relative to the support frame, the first position being a raised position for dispensing a lower roll of tissue material, the second position being a lowered position for dispensing an upper roll of tissue material; and providing an actuator that engages the lower roll of tissue material and cooperates with a channel defined by the support frame so that rotation of the actuator in response to depletion of the lower roll of tissue material allows the carriage to move from the first position toward the second position upon depletion of the lower roll of tissue material while the actuator remains engaged with the channel.

19. The method of claim 18 further comprising providing a second carriage for supporting multiple additional rolls of tissue material in a vertically stacked orientation in a side-by-side orientation relative to the multiple rolls of tissue material supported by the carriage and so that the second carriage cooperates with the support frame in a same manner as the carriage and is independently vertically translatable relative thereto between a respective first position and a respective second position.

20. A dispenser assembly configured to dispense multiple rolls of tissue material, the dispenser assembly comprising:

a carriage configured to support multiple rolls of tissue material;

a support frame constructed to receive the carriage so that the carriage is selectively slideable relative to the support frame between a first orientation wherein a lower roll of tissue material is available to be dispensed and a second orientation wherein an upper roll of tissue material is available to be dispensed;

a follower path defined by the support frame;

an actuator supported by the carriage and oriented to engage a roll of tissue associated therewith;

a follower connected to the actuator and oriented to cooperate with the follower path so that the follower is rotatable relative to the follower path to selectively allow the carriage to move from the first orientation toward the second orientation relative to the support frame in response to rotation of the actuator;

a biasing device disposed between the actuator and the carriage that is operable to bias the actuator in a direction toward an axis of rotation defined by the lower roll of tissue material; and wherein the carriage further comprises a first arm and a second arm that are each configured to support opposing ends of each of the lower roll of tissue material and upper roll of tissue material.

21. The dispenser assembly of claim 20 wherein the follower is disposed on a laterally outward facing side of at least one of the first arm and the second arm of the carriage.

22. The dispenser assembly of claim 20 further comprising a shaft that extends between the first arm and the second arm proximate the actuator.

23. A dispenser assembly configured to dispense multiple rolls of tissue material, the dispenser assembly comprising:

a carriage configured to support multiple rolls of tissue material;

a support frame constructed to receive the carriage so that the carriage is selectively slideable relative to the support frame between a first orientation wherein a lower roll of tissue material is available to be dispensed and a second orientation wherein an upper roll of tissue material is available to be dispensed;

a follower path defined by the support frame;

an actuator supported by the carriage and oriented to engage a roll of tissue associated therewith;

a follower connected to the actuator and oriented to cooperate with the follower path so that the follower is rotatable relative to the follower path to selectively allow the carriage to move from the first orientation toward the second orientation relative to the support frame in response to rotation of the actuator; and another carriage having another actuator and another follower, the support frame defining another follower passage having a same shape as the follower passage and constructed to slideably cooperate with the another follower so that the another carriage is constructed to support multiple rolls of tissue material in a same manner as the carriage and the support frame is constructed to concurrently support the carriage and another carriage such that the carriage and another carriage are independently moveable relative to the support frame so that the carriage and another carriage cooperate with the support frame in a side-by-side orientation and the dispenser assembly is capable of simultaneously holding at least four rolls of tissue material and simultaneously dispensing at least two of the at least four rolls of tissue material.

24. A dispensing apparatus comprising:

a support frame having at least one channel;

a carriage configured to hold upper and lower tissue rolls, the carriage constructed to cooperate with at least one channel defined the support frame such that the carriage is automatically moveable relative to the support frame between an upper position and a lower position;

an actuator supported by the carriage and oriented to interact with the lower tissue roll and cooperate with the at least one channel such that rotation of the actuator relative to the carriage allows translation of the carriage relative to the support frame from the upper position toward the lower position;

a cover connected to the support frame and configured to obstruct access to an upper tissue roll when the carriage is the in the upper position and allow access to a portion of the upper tissue roll when the carriage is oriented in the lower position; and wherein the support frame defines a first dual roll cavity configured to receive the carriage configured to hold upper and lower tissue rolls and a second dual roll cavity configured to receive another carriage configured to hold another upper and lower tissue rolls, the support frame including another channel oriented to support the another carriage so that the another carriage is slideable relative to the support frame independent of the carriage associated with the first dual roll cavity and such that the dispensing apparatus is configured to simultaneously hold at least four tissue rolls and simultaneously dispense only one roll of tissue rolls associated with the first dual roll cavity and the second dual roll cavity.

25. A method for forming a multiple roll tissue dispenser assembly, method comprising:

providing a carriage for supporting multiple rolls of tissue material in a vertically stacked orientation wherein the carriage defines an axis of rotation of each discrete roll of tissue material;

attaching the carriage to a support frame so that the carriage is slideable between a first position and a second position relative to the support frame, the first position being a raised position for dispensing a lower roll of tissue material, the second position being a lowered position for dispensing an upper roll of tissue material;

providing an actuator that engages the lower roll of tissue material and cooperates with a channel defined by the support frame so that rotation of the actuator in response to depletion of the lower roll of tissue material allows the carriage to move from the first position toward the second position upon depletion of the lower roll of tissue material; and providing a second carriage for supporting multiple additional rolls of tissue material in a vertically stacked orientation in a side-by-side orientation relative to the multiple rolls of tissue material supported by the carriage and so that the second carriage cooperates with the support frame in a same manner as the carriage and is independently vertically translatable relative thereto between a respective first position and a respective second position.

* * * * *